US005689748A

United States Patent [19]

Wess et al.

[11] Patent Number: 5,689,748

[45] Date of Patent: Nov. 18, 1997

[54] PHOTOGRAPHIC PROCESS WITH IMPROVED REPLENISHMENT MONITORING SYSTEM

[75] Inventors: Raymond Eugene Wess, Holley; Ralph Leonard Piccinino, Jr., Rush; John Howard Rosenburgh, Hilton, all of N.Y.

[73] Assignee: Eastman Kodak Company, Rochester, N.Y.

[21] Appl. No.: 655,106

[22] Filed: May 29, 1996

[51] Int. Cl.[6] ..... G03D 3/02

[52] U.S. Cl. ..... 396/578; 396/626; 73/308; 422/63

[58] Field of Search ..... 396/570, 624, 396/626, 578, 630; 73/293, 308, 313; 422/82.02, 82.01, 63, 64, 67; 137/386, 392, 399

[56] References Cited

U.S. PATENT DOCUMENTS

| | | | |
|---|---|---|---|
| 3,787,829 | 1/1974 | Schneier | 340/244 |
| 4,410,020 | 10/1983 | Lorenz | 73/293 |
| 4,451,433 | 5/1984 | Yamashita et al. | 73/308 |
| 5,011,571 | 4/1991 | Kobayashi et al. | 396/571 |
| 5,313,243 | 5/1994 | Rosenburgh et al. | 396/571 |
| 5,541,698 | 7/1996 | Van Den Bergen | 396/568 |

*Primary Examiner*—D. Rutledge
*Attorney, Agent, or Firm*—Frank Pincelli

[57] ABSTRACT

A method and apparatus for processing a photosensitive material. The apparatus includes at least one processing section and a replenishment system for delivering replenishment solution contained within a container to the processing section. The replenishment system including a single device for withdrawing replenishment solution from the container and for monitoring the level of the replenishment solution contained in the container. The container is made of a material that is electrically non-conductive. A pair of spaced electrically conductive members are provided within the container. One of the members has a passageway for allowing withdrawal of the replenishment solution from the container and has a terminal end which extends below the other member within the container. An AC current is applied to the pair of spaced members and the AC current is monitored with a level sensing circuit. When the replenishment solution falls below the end of the shorter member, a low level indicating signal is produced by the level sensing circuit.

16 Claims, 5 Drawing Sheets

PHOTOGRAPHIC PROCESS WITH IMPROVED REPLENISHMENT MONITORING SYSTEM

FIELD OF THE INVENTION

The present invention relates to a photographic processor, and more particularly, to a method and apparatus for monitoring the liquid level and dispensing of photographic processing solution from a replenishment container.

BACKGROUND OF THE INVENTION

In photographic processors it is important to know whether there is a sufficient supply of replenishment solution in the replenishment container from which the replenishment solution is being drawn. If there is too small of an amount of replenishment solution remaining in the supply container, then there exist the danger of drawing air into the replenishment system. This is very undesirable for a number of reasons. If air is drawn into the replenisher pump this can result in damage to the pump, or an air lock to occur which will prevent replenishment solution from being supplied which will then affect the overall chemical balance of the processing solution. Additionally, the presence of air in certain processing solutions, such as developer, can result in undesirable oxidization which will break down the processing solution and significantly affect the effectiveness of the processing solutions. Therefore, it is important to properly monitor the liquid level of the replenishment solution in the replenishment container. It is known to monitor an AC current applied to probes placed in the container holding replenishment solution for mounting the level of the liquid.

It is also necessary to provide an appropriate system for withdrawing the replenishment solution from the replenishment container. The system must be resistant to the corrosive effects of the processing solution. It is also desirable to minimize the cost of the system without sacrificing the reliability of the system.

Applicants have invented an improved liquid level sensing and delivery system which can be used in corrosive environmental applications such as that found in photographic processors for providing accurate information upon which replenishment liquid level can be monitored and for the dispensing of the replenishment from the replenishment container. The system is Of simple design and construction, low cost to manufacture, and easy to assembly.

SUMMARY OF THE INVENTION

In one aspect of the invention there is provided an apparatus for processing a photosensitive material. The apparatus includes at least one processing section and a replenishment system for delivering replenishment solution contained within a container to the processing section. The replenishment system includes a single means for withdrawing replenishment solution from the container and for monitoring the level of the replenishment in the container.

In another aspect of the present invention there is provided a method for withdrawing a replenishment solution contained within a container and for monitoring the level of the replenishment solution within the container. The container is made of a material that is electrically nonconductive. The method comprises the steps of:

providing a first electrically conductive rod within the container and a spaced second electrically conductive tube within the container, the tube having a passageway for allowing withdrawal of the replenishment solution from the container, the tube extending below the rod within the container;

applying an AC current to the rod and the tube;

monitoring the AC current with a level sensing circuit; and producing a low level indicating signal based on the monitoring of the AC current.

DETAILED DESCRIPTION OF THE DRAWINGS

DETAILED DESCRIPTION OF THE INVENTION

Figure 1:
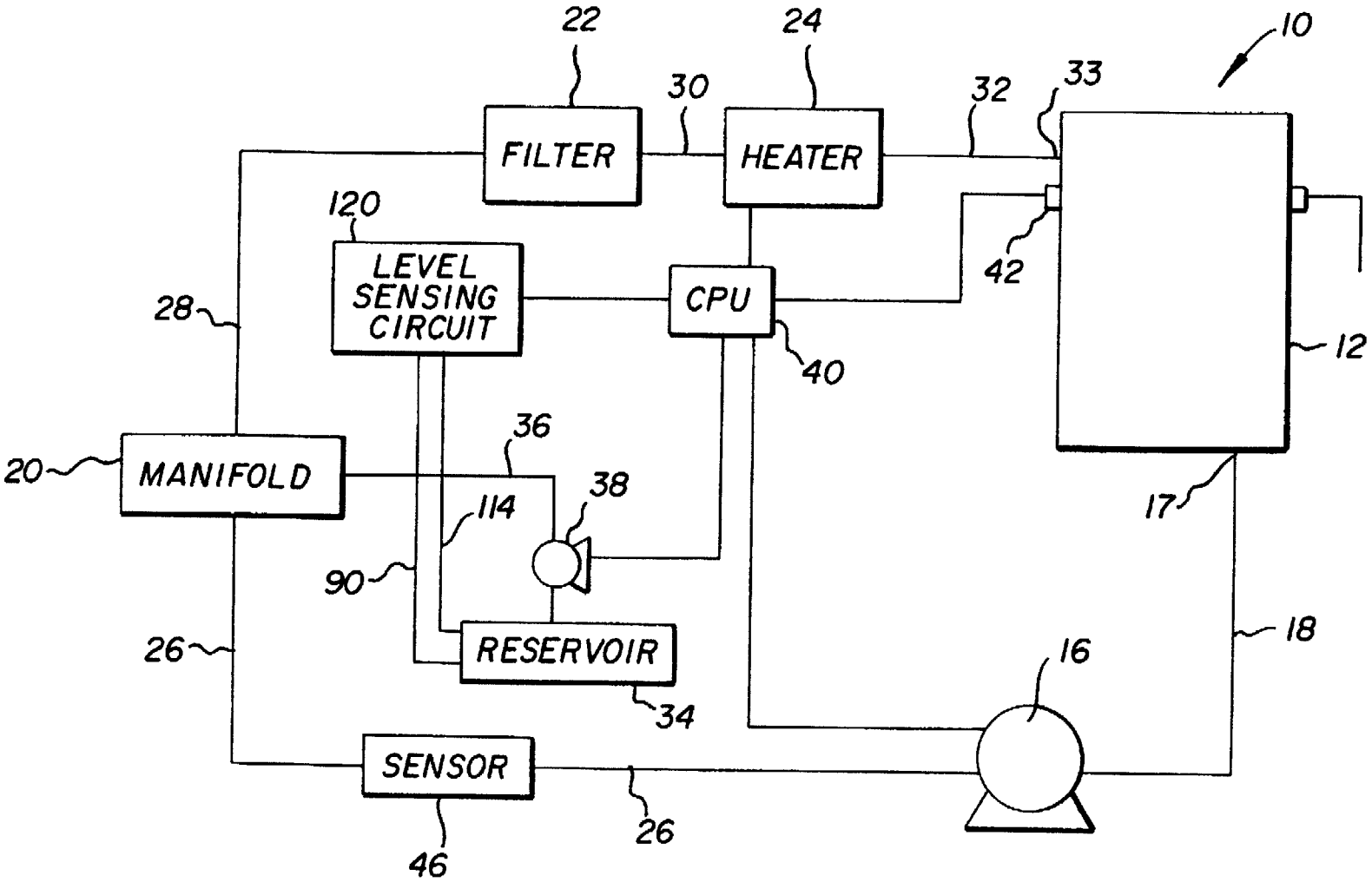
FIG. 1 is a schematic view of a processing apparatus made in accordance with the present invention.

Referring to FIG. 1, there is illustrated a processing apparatus 10 for processing photosensitive material made in accordance with the present invention. The processing apparatus 10 includes a processing section 12 wherein photosensitive material is subjected to a photoprocessing solution and a recirculation system 14 (as best seen in FIG. 2) for recirculating processing solution through the processing section 12.

In the particular embodiment illustrated in FIG. 1, the recirculation system 14 includes a pump 16 which is connected to the outlet 17 of processing section 12 by first conduit 18. The recirculation system further includes a manifold 20, a filter unit 22, and a heater 24. The pump 16 is fluidly connected to manifold 20 by a second conduit 26 and the manifold 20 is fluidly connected to filter unit 22 by a third conduit 28. A fourth conduit 30 fluidly connects the output of the filter unit 22 to the input of heater unit 24 and the output of the heater 24 is fluidly connected to the processing section 12 by a fifth conduit 32. Thus, processing solution can flow from the output 17 of the processing section through first, second, third, fourth and fifth conduits returning to the inlet 33 of the processing section.

The manifold 20 serves as a means for introducing replenishment solution from a reservoir 34 into the recirculation system 14. The reservoir 34 is fluidly connected to the manifold by appropriate sixth conduit 36. Replenishment solution is introduced from the reservoir 34 to manifold 20 by pump 38. As is typical with photographic processors, a CPU 40 (central processing unit/computer) is provided for controlling the operation of the apparatus. As is illustrated, the central processing unit 40 is connected to pumps 16,38 and to sensor 42 provided in the processing section 12. The sensor 42 is a liquid level sensor for sensing when additional processing solution is required. Recirculation system 14 includes a flow monitoring sensor 46 which is used to determine if processing solution is properly flowing through the processing recirculation system 14.

Figure 2:
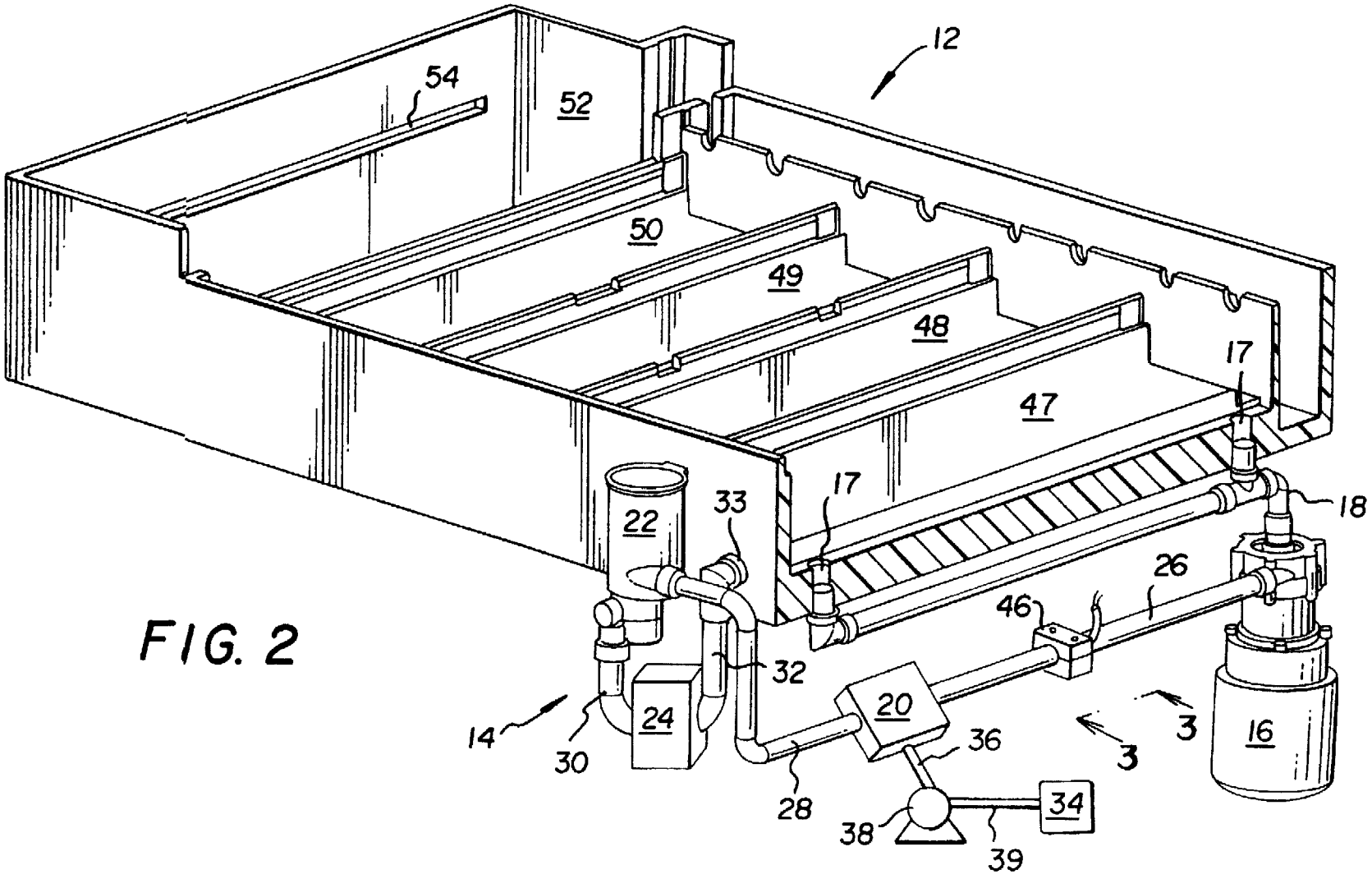
FIG. 2 is a perspective view partially broken away of a portion of an apparatus made in accordance with FIG. 1.

Referring to FIG. 2, there is shown a perspective view of a portion of the processing apparatus 10 illustrating the processing section 12 and recirculation system 14. In the particular embodiment illustrated, the processing section 12 includes four separate developing sections 47,48,49,50, each designed to contain a different processing solution. In particular, development section 47 is designed to hold a developer solution, developing section 48 is designed to hold a bleach fixed solution, and sections 49,50 are designed to hold rinse and wash solutions. Each of the processing sections include a recirculation system 14 as described and illustrated in FIG. 1, but for the sake of clarity, only a single recirculation system is illustrated in FIG. 2, it being understood that each of these processing sections have a recirculation system 14 as described and illustrated. A drying section 52 is provided after the processing section wherein the photosensitive material is dried prior to exiting slot 54. In the particular embodiment, a pair of outlets 17 are fluidly connected to conduit 18. Reservoir 34 is fluidly connected to replenishment pump 38 by conduit 39. Pump 38 draws replenishment solution from reservoir 34 and delivers it to manifold 20 through conduit 36.

Figure 3:
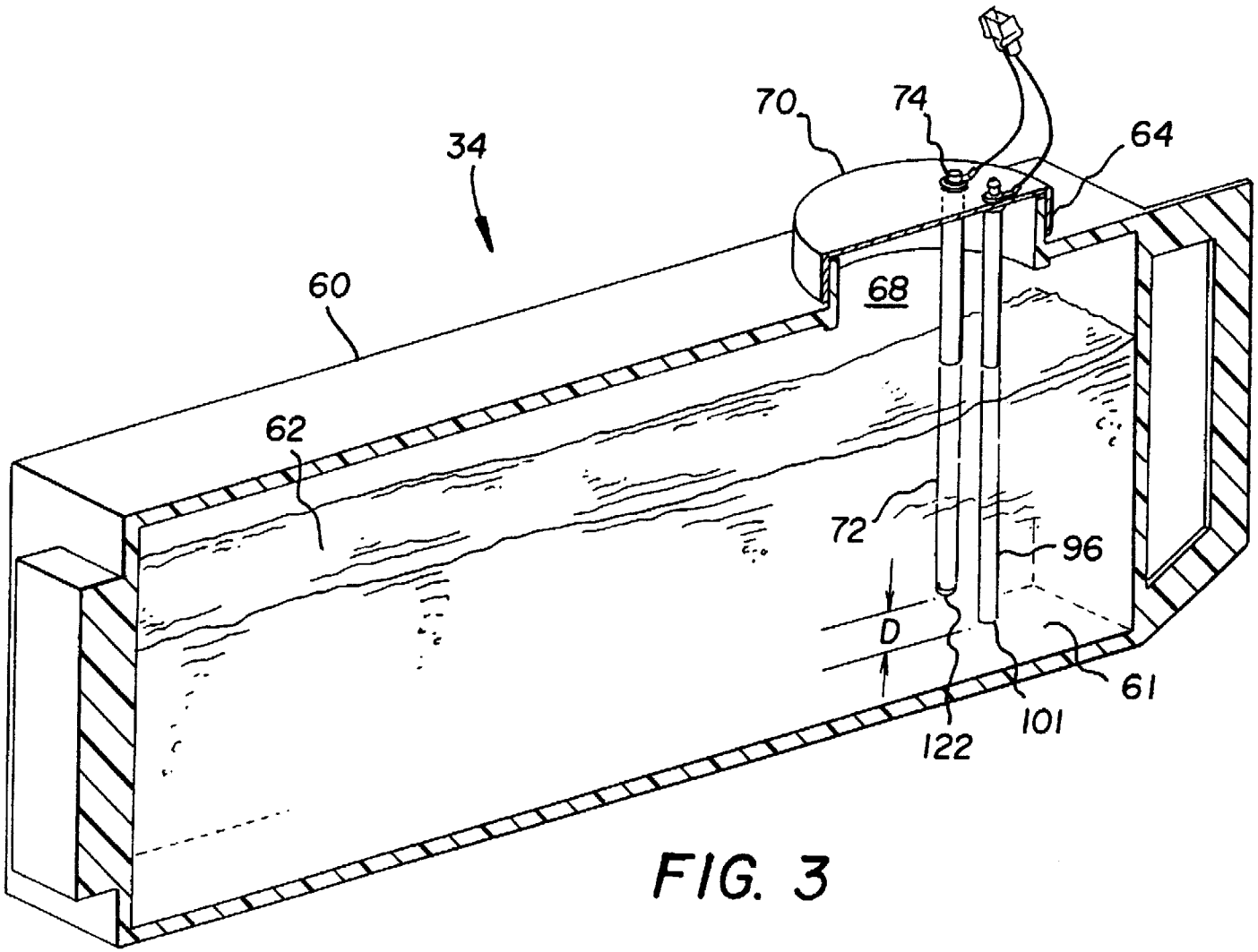
FIG. 3 is an enlarged cross-sectional view of a replenishment container made in accordance with the present invention for use in the apparatus of FIGS. 1 and 2.

Referring to FIG. 3, there is illustrated in greater detail the reservoir 34 made in accordance with the present invention. In particular, the reservoir 34 comprises a container 60 for holding a replenishment solution 62. As is typical, replenishment solution 62 is electrically conductive. The container is provided with a generally cylindrical neck portion 64 having an access opening 68 for dispensing and/or filling of replenishment solution 62 in container 60. A lid 70 is provided for engaging the neck portion 64 covering access opening 68. The use of lid 70 avoids spilling and minimizing oxidation of the replenishment solution 62. The container 60 and lid 70 are made of a non-conductive material, for example, plastic. In the embodiment illustrated, container 60 and lid 70 are made of polypropylene.

Figure 5:
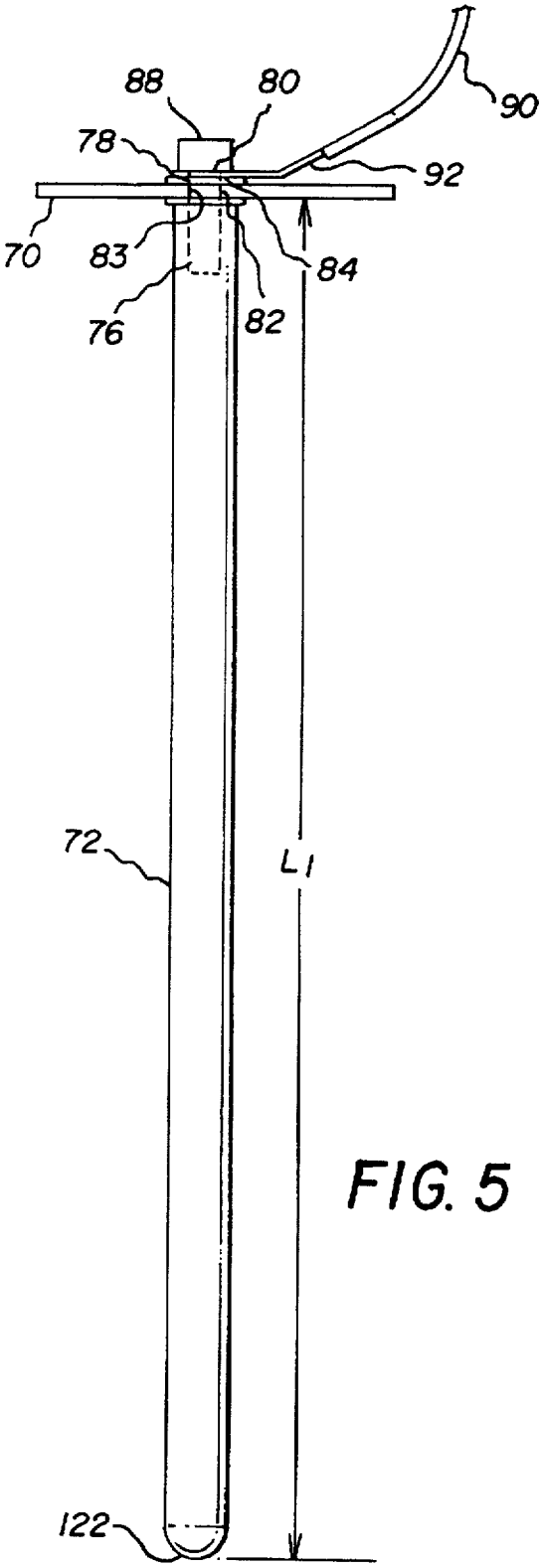
FIG. 5 is an enlarged side view of the rod used in the container of FIG. 3.

The apparatus 10 includes means for monitoring the level of the replenishment solution 62 within the container 60 and for withdrawing of the replenishment solution 62. In particular, a first level sensing rod 72, of a first predetermined length L1, is provided for placement in container 60 and has an upper end 74 which is secured to lid 70 by any conventional technique. Thus, the first level sensing rod 72 is mounted in a stationery position with respect to container 60. Rod 72 is made of a conductive and corrosive resistant material. In the embodiment illustrated, rod 72 is made of an electrically conductive stainless steel. Referring to FIG. 5, there is illustrated in greater detail how rod 72 is secured to lid 70. Rod 72 is provided with internal threads 76 for engaging the external threads 78 of electrically conductive mounting screw 80. Mounting screw 80 passes through an opening 82 in lid 70. An electrical ring terminal 84 having an opening 83 is provided and positioned for placement between the head 88 of screw 80. An electrical wire 90 has end 92 connected to terminal 84. The other end of the wire 90 is connected to an electronic control board (not shown) through connector 93 (see FIG. 3) which is controlled by CPU 40. When screw 80 is threaded into rod 72 it will cause the rod 72 to be secured to the lid 70 while also clamping the terminal 84 to the lid 70 and providing electrical connection to rod 72.

Figure 6:
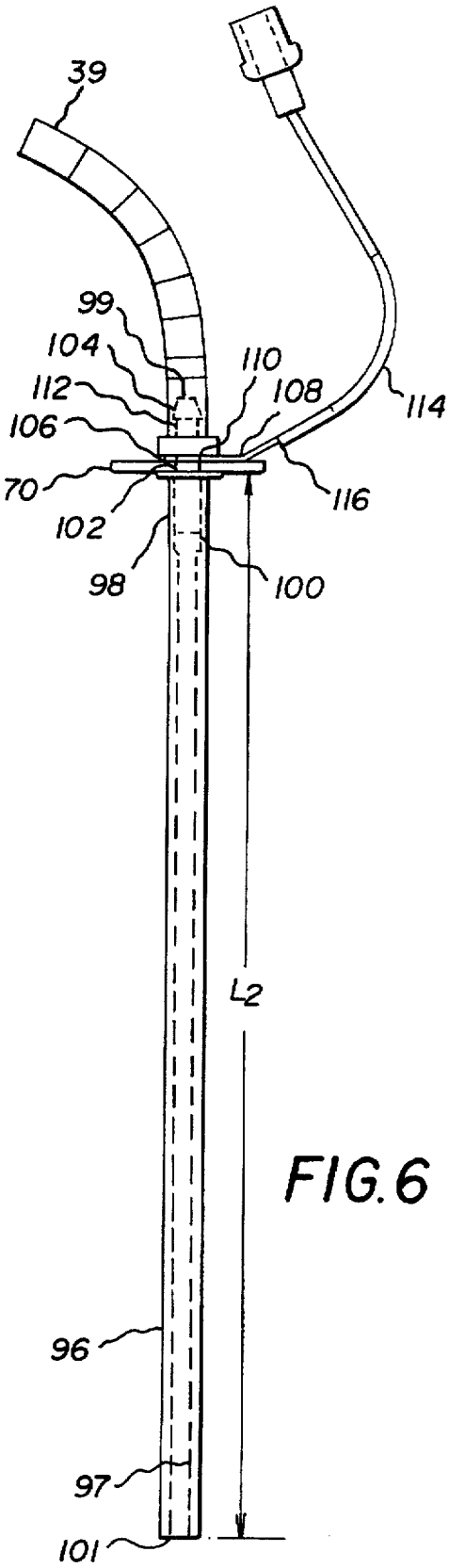
FIG. 6 is an enlarged side view of the tube used in the container of FIG. 3.

The means for monitoring the level of the processing solution within the container 60 and for withdrawing of the replenishment solution 62 further includes a second level sensing tube 96 (see FIG. 6) of a second predetermined length L2 and has an upper end 98 which is secured to lid 70 by any conventional technique. Thus, the robe 96 is also mounted in a stationary position with respect to the container 60. Tube 96 has an internal passage 97 which extends through the length L2 and terminates in an inlet opening 101 for drawing replenishment solution 62 therein. The tube 96 is made of a conductive and corrosive resistant material, and in the particular embodiment illustrated, is made of an electrically conductive stainless steel. Referring to FIG. 6, there is illustrated in Greater detail how tube 96 is secured to lid 70. Tube 96 is provided with internal threads 100 for engaging the external threads 102 of electrically conductive mounting fitting 104. Mounting fitting 104 passes through an opening 106 in lid 70. An electrical ring terminal 108 having an opening 110 is provided and positioned for placement between the head 112 of fitting 104. An electrical wire 114 has end 116 connected to terminal 108. The other end of the wire 114 is connected to an electronic control board (not shown) also through connector 93, which is controlled by CPU 40. When fitting 104 is threaded into tube 96, it will cause the tube 96 to be secured to the lid 70 while also clamping the terminal 108 to the lid 70 and providing electrical connection to tube 96. The fitting has an internal passage 99 which is in fluid communication with the passage 97 of tube 96. Conduit 39 is fluidly connected to fitting 104.

A level sensing circuit 120 is connected to other ends of wires 90,114 and provides an AC current through tube 96 and rod 72. The level sensing circuit 120 sends a monitoring signal to CPU 40 which is representative of the presence of the replenishment solution 62 in container 60. AC current is used so as to prevent plating of the rod 72 and tube 96. Any appropriate amount of current may be applied to rod 72 and tube 96. In the particular embodiment illustrated, AC current in the range of about 200 to 300 microamps are applied.

In order to more clearly understand the present invention, a description of its operation will now be discussed. First a container 60 which is filled with a replenishment solution 62 is provided. The lid 70 with secured rod 72 and tube 96 is placed on neck 64. The length L2 of tube 96 is greater in length than the length L1 of rod 72. The length L2 is such that opening 101 is closely adjacent the bottom 61 of container 60. The level sensing circuit 120 (see FIG. 1) is activated so as to provide an AC current through rod 72, tube 96 and replenishment solution 62. Since replenishment solution 62 is electrically conductive, a signal will be detected by the level sensing circuit 120 as long as the replenishment solution completes the electrical connection between the rod 72 and tube 96. In the embodiment illustrated, the level sensing circuit 120 is an LM1830 integrated circuit which may be purchased from a typical electronic supplier, such as the National Semiconductor Corporation. When the level of the replenishment solution 62 falls below the bottom end 122 of rod 72, the AC current is interrupted causing the level sensing circuit 120 to detect a change in condition which is representative of the lack of presence of the replenishment solution, that is, the level of the replenishment solution 62 is below end 122. The level sensing circuit 120 then sends an appropriate signal to CPU 40 which in turn turns off pump 38. If desired, an alarm or signal may be provided for notifying an operator of the condition of the liquid level in the container 60. The length L1 and L2 are selected so that most of the replenishment solution will have been removed from container 60, yet having a difference in length D is such that the pump 38 will be turned off prior to taking air into tube 96. In the particular embodiment illustrated, the difference in length between L1 and L2 is approximately ¼ inches (0.632 cm). However, the difference may be any desired amount so long as it provides the As can be seen, the present invention not only provides means for supplying replenishment solution, but also provides means for sensing the level of fluid. Additionally, the system is relatively simple in construction, low cost, and very reliable.

Figure 4:
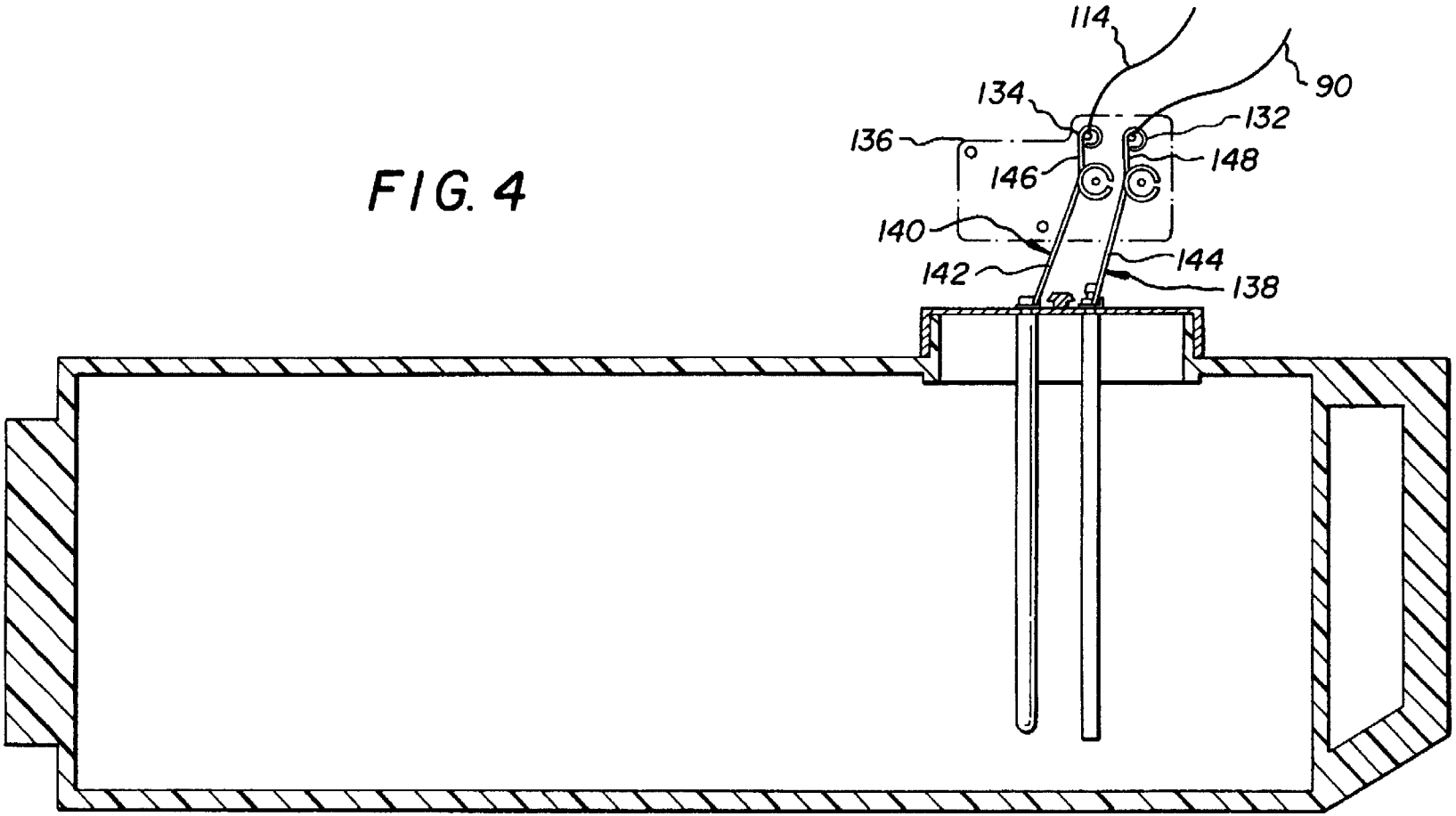
FIG. 4 is a cross-sectional view of a modified replenishment container made in accordance with the present invention.

Referring to FIG. 4, there is illustrated a modified form of the present invention. This system is similar to that of FIG. 2, like numerals indicating like parts and operation, previously described, and is incorporated herein. In this embodiment there is provided an automatic quick disconnect assembly 130 for allowing quick disconnect of the electrical wires 90,114. In this embodiment wires 90,114 are connected to electrical terminals 132,134, respectively, on an electrical mounting plate which is secured to apparatus 10. A pair of electrical conductive spring members 138,140 are secured to mounting plate 136. Each spring member 138,140 has a flexible lower spring end 142,144 which contact terminals 84,108, respectively, when the container is properly seated in apparatus 10. Members 138,140 each have an upper portion 146,148, respectively, which are designed to contact terminals 132,134 on plate 136. Thus, there is provided electrical connection between rod 72, tube 96, and wires 90,114, respectively. When the container 60 is removed from apparatus, the lower ends 142,144 deflect so as to allow removal of the container. Likewise, the members flex to allow insertion of a freshly filled container 60. In this manner no manual electrical disconnection of wires 90,114 is required. Electrical connection is automatically made simply by proper positioning of the container 60. Once conduit 39 is disconnected from fitting 104, the container is simply removed for refilling and/or replacement.

The present invention provides an improved flow monitoring system which is low cost, accurate, and is not subject to corrosive effects of the processing solution.

It is to be understood that various changes and modifications may be made without departing from the scope of the present invention, the present invention being defined by the claims that follow.

Parts List:

10 . . . processing apparatus
12 . . . processing section
14 . . . recirculation system
16,38 . . . pump
17 . . . outlets
18 . . . first conduit
20 . . . manifold
22 . . . filter unit
24 . . . heater
26 . . . second conduit
28 . . . third conduit
30 . . . fourth conduit
32 . . . fifth conduit
33 . . . inlet
34 . . . reservoir
36 . . . sixth conduit
39 . . . conduit
40 . . . CPU
42 . . . sensor
46 . . . flow monitoring sensor
47,48,49,50 . . . developing sections
52 . . . drying section
54 . . . exiting slot
60 . . . container
61 . . . bottom
62 . . . replenishment solution
64 . . . neck portion
68 . . . access opening
70 . . . lid
72 . . . first level sensing rod
74 . . . upper end
76 . . . internal threads
78 . . . external threads
80 . . . mounting screw
82,83 . . . opening
84 . . . electrical ring terminal
88 . . . head
90,114 . . . electrical wire
92 . . . end
93 . . . connector
96 . . .second level sensing tube
97,99 . . . internal passage
98 . . . upper end
100 . . .internal threads
101. . . opening
102 . . . external threads
104 . . . mounting fitting
106 . . . opening
108 . . . electrical ring terminal
110 . . . opening
112 . . . head
116 . . . end
120 . . . sensing circuit
122 . . . bottom end
130 . . . disconnect assembly
132,134 . . . electrical terminals
136 . . . mounting plate
138,140 . . . spring members
142,144 . . . flexible lower spring end
146,148 . . . upper portion

We claim:

1. A processor for processing a photosensitive material, comprising:

at least one processing section;

a recirculation system for circulating processing solution through said at least one processing section, said recirculation system including at least one conduit for recirculating processing solution;

a replenishment system for delivering replenishment solution contained within a container to said recirculation system, said replenishment system including a single means secured to said container for withdrawing replenishment solution from said container and for monitoring the level of the replenishment in said container.

2. A processor according to claim 1 wherein said single means comprises a first electrically conductive rod of a first predetermined length and a tube of a second predetermined length, said rod and tube extending into said container and being positioned for detection when the replenishment solution falls to a predetermined level, said tube extending further into the replenishment solution than said rod, said tube capable of withdrawing the replenishment solution from said container.

3. A processor according to claim 2 further comprising a level sensing circuit, said circuit being electrically connected to said rod and said tube and for applying an AC current thereto.

4. A processor according to claim 3 wherein said level sensing circuit produces a signal when the processing solution falls below the bottom of the rod.

5. A processor according to claim 2 wherein said rod and said tube are secured to a lid which engages an opening in said container, said container and said lid being made of a non-electrically conductive material and said rod and said tube are made of an electrically conductive material.

6. A processor according to claim 5 wherein said rod and said tube are made of stainless steel.

7. A processor according to claim 3 wherein means are provided for allowing automatic quick electrical disconnect and connection of said rod and tube to said level sensing circuit.

8. A method for withdrawing a replenishment solution contained within a container and for monitoring the level of said replenishment solution within said container, said container being electrically non-conductive, said first electrically conductive member and said second electrically conductive tube being mounted in a stationery position with respect to said container, comprising the steps of:

providing a first electrically conductive member within said container and a spaced second electrically conductive tube within said container, said tube having a passageway for allowing withdrawal of the replenishment solution from said container, said tube extending below said rod within said container;

applying an AC current to said rod and said tube;

monitoring said AC current with a level sensing circuit; and producing a low level indicating signal based on said monitoring of said AC current.

9. A method according to claim 8 further comprising the step of stopping any further withdrawal of replenishment solution when said low level indicating signal is produced.

10. A processor for processing a photosensitive material, comprising:

at least one processing section;

a replenishment system for delivering replenishment solution contained within a container to said processing section, said replenishment system including a single means secured to said container for withdrawing replenishment solution from said container and for monitoring the level of the replenishment in said container.

11. A processor according to claim 10 wherein said single means comprises a first electrically conductive rod of a first predetermined length and a tube of a second predetermined length, said rod and tube extending into said container and being positioned for detection when the replenishment solution falls to a predetermined level, said tube extending further into the replenishment solution than said rod, said tube capable of withdrawing the replenishment solution from said container.

12. A processor according to claim 11 further comprising a level sensing circuit, said circuit being electrically connected to said rod and said tube and for applying an AC current thereto.

13. A processor according to claim 12 wherein said level sensing circuit produces a signal when the processing solution falls below the bottom of the rod.

14. A processor according to claim 11 wherein said rod and said tube are secured to a lid which engages an opening in said container, said container and said lid being made of an non-electrically conductive material and said rod and said tube are made of an electrically conductive material.

15. A processor according to claim 14 wherein said rod and said tube are made of stainless steel.

16. A processor according to claim 12 wherein means are provided for allowing automatic quick electrical disconnect and connection of said rod and tube to said level sensing circuit.

* * * * *